United States Patent [19]
Pavilcius et al.
[11] 4,139,451
[45] Feb. 13, 1979

[54] METHOD FOR DEWATERING COKE TAR-WATER MIXTURES

[75] Inventors: Audrone M. Pavilcius, Chicago; William H. Lindenberger, Darien, both of Ill.

[73] Assignee: Nalco Chemical Company, Oak Brook, Ill.

[21] Appl. No.: 859,418

[22] Filed: Dec. 12, 1977

[51] Int. Cl.² ..... C10C 1/02
[52] U.S. Cl. ..... 208/39; 208/22; 208/45; 208/188; 252/328; 201/41
[58] Field of Search ..... 208/45, 188, 39, 22; 252/328

[56] References Cited

U.S. PATENT DOCUMENTS

| | | | |
|---|---|---|---|
| 3,135,681 | 6/1964 | Pflasterer | 208/45 |
| 3,880,752 | 4/1975 | Premo | 208/188 |

OTHER PUBLICATIONS

Irving Picus et al., Ind. Eng. Chem. 43, pp. 521–524, 1951.
Herbick et al. The Making, Shaping and Treating Steel, 9th Ed. Pittsburgh, Pa. pp. 90, 105–106, 165–168, 1971.

*Primary Examiner*—Veronica O'Keefe
*Attorney, Agent, or Firm*—John G. Premo; Robert A. Miller

[57] ABSTRACT

A method for dewatering tar-water mixtures obtained from the coking of coal is disclosed. The method involves adding to the tar from 150 to 3,000 ppm of a di-tri butyl ethoxylated phenol compound dissolved in water, heating the tar-water mixture, and then agitating it to allow contact with the chemical additive. This is followed by allowing the mixture to settle forming an aqueous upper phase and a lower dewatering tar phase.

5 Claims, No Drawings

METHOD FOR DEWATERING COKE TAR-WATER MIXTURES

INTRODUCTION

In the production of coke from coal in by-product coke ovens, tar is recovered as one of the by-product materials. This material is useful for many different purposes including the production of asphalt, pitch, heating fuels and the like. When utilizing this tar, however, it is important that it be relatively free from water. While in theory tar produced from by-product coke ovens should contain only small quantities of water, oftentimes substantial quantities of water, up to 40–60%, can be emulsified with the tar.

In order to utilize the resultant tar, the water emulsified with the tar must be removed. While some water removal can be accomplished by letting the tar-water emulsion settle, this process requires a lengthy period of time and due to the volume of tar produced by most large coke oven batteries, storage of large quantities of material, while the water settles, is impractical. While heating helps the above settling process rendering the viscous tar fluid, the removal of water is still relatively slow.

In recent years various chemical additives have been employed both with and without success for the dewatering of tar-water mixtures or emulsions. It is an object of this invention to provide to the art an improved emulsion breaker and process for the dewatering of tar-water mixtures thereby allowing the rapid recovery of dewatered tar without the need for excessive storage capabilities.

OBJECTS

It is, therefore, an object of this invention to provide to the art a new and effective agent for the dewatering of tar.

A further object of this invention is to provide to the art a process for obtaining a dewatered tar useful in a variety of applications by the addition to a tar-water mixture, with heating and agitation of a di-tri butyl phenol reacted with 12 moles of ethylene oxide whereby water separates from the tar.

Further objects will appear hereinafter.

THE INVENTION

This invention provides a method for dewatering tar obtained as a by-product in the production of foundry and metallurgical grade coke from coal utilizing the following steps:

A. Collecting a tar-water mixture containing greater than 5% by weight water as a by-product from the production of coke from coal;

B. Adding to said tar-water mixture from 150 to 3,000 ppm of a di-tri butyl ethoxylated phenol contained in water;

C. Heating said tar-water mixture to increase its fluidity;

D. Agitating said tar-water mixture to mix it with the phenol compound of step B;

E. Continuing steps C and D for a period of time to allow interaction of the compound of step B with the tar-water mixture;

F. Discontinuing agitation, thereby allowing the water contained in the tar-water mixture to rise to the surface forming an aqueous upper phase and a lower dewatered phase;

G. Removing said aqueous upper phase; and

H. Recovering a dewatered tar.

Most metallurgical grade coke produced is made by the by-product process. During this process volatile products are liberated and recovered as gas and coal chemicals along with the desired product, coke. During carbonization of coal to coke, from 20–35% by weight of the initial charge of coal is evolved as mixed gases and vapors which pass from the ovens into collecting mains and are processed through the coal-chemical recovery section of the coke plant to produce coal chemicals.

The amount of tar produced can vary widely based on the starting coals employed and the collection conditions but averages 8–12 gallons per ton of coking coal. This tar is organic matter that separates by condensation from the gas in the collector mains of the coke oven battery. It is a black viscous liquid having a slightly higher specific gravity than that of water and contains, among other compounds, pyridines, tar acids, naphthalene, creosote oil and coal-tar pitch.

In most modern by-product coke ovens, the gas produced passes out of the oven chamber and eventually into a collection main. The gas and vapors leaving the oven are generally at temperatures in the range of from 1100° to 1300° F. and are collected by spraying the gas with flushing liquor after leaving the oven chambers. The cooling is effected by the evaporation of a portion of water in the flushing liquor which removes some of the heat from the gas and condenses some of the vapors with the resultant condensation of heavy tars from the gas.

The flushing liquor used for cooling in the spray system is an aqueous mixture which has been condensed in the mains, collected and recirculated. This material generally amounts to approximately 800 to 2,000 gallons per ton of coal carbonized. This flushing liquor which cools and condenses the various vapors in the gas provides a carrying media for the condensible tar and other compounds formed in the operation. These liquid materials flow from the collecting mains through a seal into a downcomer and are delivered through the return flushing liquor lines to a collecting unit generally called a "flushing liquor decanter tank".

The flushing liquor decanter tank serves a two-fold purpose in the processing of liquid condensates and recirculating liquor. First of all, it provides a settling basin in which the velocity of the tar and liquor is reduced and enables gravity separation of tar and liquor. Secondly, the flushing liquor decanter tank serves as a settling point for solids materials. They are collected along with the tar and liquor from the collecting main.

The flushing liquor decanter is normally a steel tank inclined at one end facilitating the recovery of solid accumulations. The tar and flushing liquor enter the decanter tank and flow into a trough which is designed to minimize agitation of the mixture in the decanter. The mixture overflows the trough into the main compartment where the velocity is reduced to permit the tar, which has a higher specific gravity than the flushing liquor, to settle to the bottom. At this point, the flushing liquor recovered flows over a fixed weir at the opposite end of the decanter and into the connecting lines to be recirculated. The tar that is collected leaves the bottom of the decanter through an adjustable seal generally known as a decanter valve which can be raised or lowered. Tar quality is generally controlled by adjusting this seal either upwards or downwards to regulate the retention time of the tar in the decanter.

While in some cases the tar recovered from the flushing liquor will contain low levels of water, e.g. from 2–5%, oftentimes the tar recovered contains substantial quantities of water and further decondensation or blending is required to reduce the water content. This has generally been accomplished by placing the tar in receiving tanks and separating tanks in the process lineup prior to tar storage tanks. These tanks are simply intermediate storage tanks for receiving tar from the decanter and depending on the water content of the tar in the receiver, the tar may be pumped directly to storage, heated to lower the water content, or pumped back into the decanter system.

While in the description of this invention, the terms, water and tar-water mixtures, are used, it should be pointed out that the "water" is essentially the flushing liquor and contains, in addition to water, light hydrocarbon fractions, ammonia, phenols, naphthalenes, etc. Due to the presence of the organic material and the ammonia, this water is particularly difficult to separate from the tar and thus the employment of this invention provides a coke tar of superior quality.

While as stated above, heat can sometimes reduce the moisture content of tar causing the separation of tar and water by the increase in the fluidity of the tar-water mixture, heating by itself is oftentimes ineffective for this purpose, utilizing valuable fuel taking up valuable storage facilities. The instant invention utilizes chemical treatment along with heating and agitation to more rapidly separate a lower tar phase and an upper aqueous phase from the water-tar mixture.

CHEMICAL TREATMENT

The chemical treating agent preferably utilized in this invention to effect the dewatering of coke tar is a mixture of di and tri butyl phenols which have been ethoxylated with 12 moles of ethylene oxide. While the di and tri butyl phenol mixture which is ethoxylated is a preferred embodiment of this invention, it is suspected that other similar materials which can be reacted with an alkylene oxide will also function in this invention. Thus mono, di, and tri methyl, ethyl, propyl, butyl, hexyl, heptyl and octyl phenols and mixtures thereof which have been reacted with sufficient alkylene oxide to render the molecules soluble in water may perform in this invention. Alkylene oxides which can be utilized in this invention to react with the phenol compound include ethylene, propylene, and butylene oxides. While the extent of alkoxylation will depend upon the particular phenol compound employed, the moles of alkylene oxide reacted with the phenol can generally range from 4–20 and, preferably, from 8–16.

As stated above, the preferred molecule for use in this invention is a mixture of di and tri butyl phenols which have been reacted with 12 moles of ethylene oxide. The di and tri butyl phenol mixture which is utilized is a by-product of a chemical plant and a complete analysis is not available to the best of applicants' knowledge.

In the formulation of the compounds of the instant invention, we have found surprisingly that when these materials are used in an aqueous solution, their activity is much higher than when dissolved in a hydrocarbon solvent. Thus, it is important within the scope of this invention that the alkoxylated phenol compounds be soluble in water and are added to the tar-water mixture in the form of an aqueous solution. While those skilled in the art will readily see that these materials can be dissolved in many concentrations in the water, it is preferred to make the solutions as concentrated as possible due to the volume of chemical to be employed. Thus, aqueous solutions as high as 60–70% by weight of the chemical treating agent of this invention are contemplated. Preferably, from 20–60% by weight of the compound is dissolved in an aqueous solution and, most preferably, from 30–50% by weight.

The compounds of this invention are added to the tar-water mixture at levels of from 150–4,000 ppm as the active material. Due to the nature of the tar-water mixture and the fact that it can vary depending upon coking coal mixtures, coking procedures and collection practices, this dosage level can vary substantially. We have, however, seen good results when the material is used at the above level and, preferably, at a level of from 200 to 2,000 ppm.

The materials of the instant invention are generally added to cause the breaking of the tar-water emulsion directly to the tar-water mixture. This can be accomplished in a variety of ways. Should the tar be stored in a tank having an agitator, it is only necessary that a suitable quantity of the composition of this invention be added to the tank. In most cases, however, tar storage tanks of this type are not equipped with suitable agitation devices and, thus, other means for intimately admixing the composition of this invention with the tar-water mixture must be employed. One of the most satisfactory methods which we have found is to recirculate the tar-water mixture utilizing a pump having an outlet at the top or bottom of the tank and an inlet at the reverse position. The treating agent of the invention is added at the suction side of this recirculating pump thereby allowing for the intimate mixing of the tar and the treating agent. As will readily be apparent to those skilled in the art, other means for agitation can be employed and these are included within the scope of this invention.

HEATING

In the use of the process of this invention, the tar-water mixture in conjunction with the chemical treatment is heated to a temperature generally between 130° and 250° F. and, more preferably, between 160° and 220° F. This rise in temperature decreases the viscosity of the tar-water mixture, thereby allowing it to be more intimately mixed with the chemical treatment, thus allowing a more effective water separation. With the use of a non-viscous tar, it should be pointed out this heating step would not be necessary or lower temperatures could be utilized. Thus the viscosity of the tar-water mixture will have a profound effect upon the degree of heating necessary.

Oftentimes tar being recovered from by-product coke ovens is already at the desired temperature and no further heating will be necessary. It should be pointed out, however, that heating is essential when the tar-water mixture is viscous both during the agitation step described below and during the period of time in which the tar-water mixture is allowed to settle, forming a tar-rich lower phase and an aqueous upper phase.

AGITATION

The heated tar-water mixture, in conjunction with the chemical treatment, is agitated to mix it with the chemical treatment. Since most tar storage tanks are not equipped with agitator means for agitating the contents of the tank, we have found that by simply pumping the heated tar mixture from top to bottom of the tank utilizing a recirculating pump serves this purpose. The amount and time of agitation employed in this invention is critical and variable depending upon the nature of the specific tars to be treated.

THE SEPARATION OF THE TAR FROM THE WATER

After the chemical treatment, heating and agitation has been sufficient to break the tar-water mixture, the agitation is stopped. This allows the treated tar-water mixture to separate into two phases, the tar ending up in a lower tar phase and the water contained in the tar winding up in an aqueous upper phase. This separation may take from several minutes to several hours to several days to accomplish depending upon the viscosity of the tar-water mixture employed and the temperature employed. By knowing the approximate water content of the tar-water mixture started with, one can readily ascertain the volume of water that should be obtained in this process and settling is allowed to take place until the approximate theoretical amount of water results in the upper aqueous phase. After settling, the upper aqueous phase is decanted or otherwise removed from the tank and the lower tar phase is transferred to a storage tank for further processing or use.

The time required for this separation procedure is variable depending upon the particular tar-water mixture being treated. While some tar mixtures will only require several hours of standing at elevated temperatures, other mixtures may require several days in order to effectuate a good break between the tar and the water. The amount of time, therefore, must be chosen on a case by case basis which those skilled in this art will readily appreciate.

In order to illustrate this invention, the following examples are presented:

EXAMPLE 1

A mixture of di and tri butyl phenols was ethoxylated to a level of 12 moles of ethylene oxide per mole of phenol. The di and tri phenol material utilized was a waste stream of a chemical manufacturer.

This material was then dissolved in water by simple mixing to form a 40% by weight aqueous solution of the ethoxylated di and tri butyl phenol compound. This material was utilized in the following examples.

EXAMPLE 2

An evaluation of the compound described in Example 1 was performed on a 10,000 gallon tank of tar at a large coke plant producing metallurgical grade coke. The tar was recirculated through the tank using a transfer pump with the compound of Example 1 being fed on the suction side of the pump at a level of 1,000 ppm. After the chemical dosaging was complete, the tank was allowed to set for 48 hours at which time samples were taken to determine the effectiveness of the treatment. The sample showed that the water had been broken out from the tar and was trapped between large pockets in the tar instead of forming a distinct layer. It was found that stirring facilitated the formation of a water layer and, thus, the tank was recirculated for 2–3 hours and then allowed to stand for two days. At that time, the tar-water break was apparent. Moisture content of the tar was approximately 9% by weight. This tar had an initial moisture content of between 45–50% by weight. Thus, the treatment of this invention lowered the moisture content of the tar from a level of from between 45–50% by weight to 9% by weight.

EXAMPLE 3

The compound of Example 1 was employed to treat a coke tar having a moisture content of from 6–7%. Two thousand ppm of the compound of Example 1 was added, and the mixture was heated to 160°. The tank which contained the tar was mixed and agitation was then stopped overnight. The next morning a clear tar-water break was noted, and the moisture level of the tar was found to be 1.7%.

EXAMPLE 4

Tar obtained from a large Midwestern steel plant using both preheated and non-preheated type coals in their coking process was treated with the composition of Example 1. Utilizing a dosage of between 1,500 to 2,000 ppm, mixing well, and heating at temperatures of from 180° to 200° F. for 18 hours, followed by allowing settling, tars having moisture contents of 11% and 14% respectively were lowered to moisture contents of less than 2% by weight.

EXAMPLE 5

Tar produced by a large Western steel mill was treated with the composition of Example 1. Five hundred ppm of the composition of Example 1 was added to the tar with agitation. The mixture was heated to 180° and then agitated to sufficiently mix the chemical additive with the tar-water mixture. After agitation was stopped, heating was conducted for an additional 12–18 hours at 180°. The tar was then allowed to settle, yielding a material having a moisture content of less than 1%.

EXAMPLE 6

Tar produced by a major steel mill's Midwest facility was treated using the composition of Example 1. The tar, originally having a moisture content of 31% by weight water, was reduced to a moisture content of 8–12% by weight with chemical treatment and the method of this invention. Another sample of tar from the same facility having a moisture of 52% was reduced to approximately 6% water using the composition of this invention. One thousand ppm of the compound of Example 1 was used in both cases with heating at 180°–210° F.

The treated tar was of a high enough quality so as to be suitable for use in the boilers of the steel plant or for sale to a reprocessor.

We claim:

1. A method for dewatering tar obtained as a by-product in the production of foundry and metallurgical coke from coal which comprises:

A. Collecting a tar-water mixture containing greater than 5% by weight water as a by-product from the production of coke from coal;

B. Adding to said tar-water mixture from 150 to 3,000 ppm of a di-tri butyl ethoxylated phenol said di-tri butyl ethoxylated phenol having been prepared by reacting a mixture of di and tri butyl phenols with from 4–20 moles of ethylene oxide per mole of phenol, said di-tri butyl ethoxylated phenol being present in a 20–60% by weight aqueous solution;

C. Heating said tar-water mixture to a temperature of from 130°–250° F. to increase its fluidity;

D. Agitating said tar-water mixture to mix it with the phenol compound of step B;

E. Continuing steps C and D for a period of time to allow interaction of the compound of step B with the tar-water mixture;

F. Discontinuing agitation, thereby allowing the water contained in the tar-water mixture to rise to the surface forming an aqueous upper phase and a lower dewatered tar phase;

G. Removing said aqueous upper phase; and,

H. Recovering a dewatered tar.

2. A method of claim 1 wherein the di-tri butyl ethoxylated phenol contains 12 moles of ethylene oxide per mole of phenol.

3. The method of claim 1 where agitating the tar-water mixture is accomplished utilizing a recirculating pump.

4. The method of claim 1 wherein in step C the tar-water mixture is heated to a temperature of from 160° to 220° F.

5. The method of claim 1 wherein from 200 to 2,000 ppm of the di-tri butyl ethoxylated phenol is added to the tar-water mixture.

* * * * *